US007668444B2

(12) United States Patent
Tsai

(10) Patent No.: US 7,668,444 B2
(45) Date of Patent: Feb. 23, 2010

(54) PIPE HEATER ENCIRCLED CONDUIT DEVICE

(76) Inventor: Hua-Hsin Tsai, No. 105, Jhongyang Rd., Jioucyong Village, Linnei Township, Yunlin County (TW)

( * ) Notice: Subject to any disclaimer, the term of this patent is extended or adjusted under 35 U.S.C. 154(b) by 174 days.

(21) Appl. No.: 11/882,140

(22) Filed: Jul. 31, 2007

(65) Prior Publication Data

US 2009/0034947 A1 Feb. 5, 2009

(51) Int. Cl.
*A45D 20/40* (2006.01)

(52) U.S. Cl. ..... 392/407; 392/465; 392/478; 392/483

(58) Field of Classification Search ..... 392/483
See application file for complete search history.

(56) References Cited

U.S. PATENT DOCUMENTS 2,589,566 A * 3/1952 Neth et al. ..... 392/479
5,559,924 A * 9/1996 Kadotani et al. ..... 392/483
6,091,890 A * 7/2000 Gruzdev et al. ..... 392/485
6,157,778 A * 12/2000 Kadotani ..... 392/483
6,236,810 B1 * 5/2001 Kadotani ..... 392/485

* cited by examiner

*Primary Examiner*—Thor S Campbell
(74) *Attorney, Agent, or Firm*—Rosenberg, Klein & Lee

(57) ABSTRACT

The present invention relates to a pipe heater encircled conduit device (1), in which a heating element (111) wrapped with a filament (112) having high resistance is provided and a hollow quartz inner tube (113) is inserted at the outside of said heating element (113) to form a pipe heater (11), both ends of the heating element (111) being connected with an electrode pin (114) respectively. A hollow quartz outer tube (123) is inserted at the outside of the pipe heater (11), which has an inlet (121) and an outlet (122) on the tube wall. A heat transfer space (A) is thus formed between the inner quartz tube (113) and the outer quartz tube (123), and insulation members (124) are combined with the respective opening end of both tubes. By the arrangement of the inner and outer quartz tubes. (113), (123), the heat energy generated by the pipe heater (11) formed by the heating element (111) and the hollow inner quartz tube (113) can be transferred to the medium which is introduced from the inlet (121) and exhausted from the outlet (122). Thus, the medium can be heated by the heat energy generated by the heating element (111) itself by both actions of heat conduction and heat radiation.

6 Claims, 10 Drawing Sheets

PIPE HEATER ENCIRCLED CONDUIT DEVICE

BACKGROUND OF THE INVENTION

1. Field of the Invention

The present invention relates to a pipe heater encircled conduit device in which the heat energy can be transferred through a space between a hollow inner quartz tube and a hollow outer quartz tube by both actions of heat conduction and radiation.

2. Brief Description of the Prior Art

As shown in FIG. 10, conventional pipe heater (3) generally has a hollow metal pipe (31) in which a heating element (32) is provided, and electrode pins (33) for connection with outside power source are connected to both ends of the heating element (32). Kaolinite (34) for insulation purpose is filled within the hollow metal pipe (31). Then, the hollow metal pipe (31) is rolled so as to make the filled kaolinite become more compact. Both ends of the hollow metal pipe (31) are sealed by the resin glue (35) so that the interior of the hollow metal pipe (31) is in sealed state. However, the pipe heater (3) is placed within the barrel having heat insulation that is used to hold water. The hollow metal pipe (31) in long term contact with water causes oxidization easily which results in gradual corrosion. Serious corrosion often leads to the rupture of the hollow metal pipe (31), in turn gives rise to current leakage problem. Furthermore, large amount of mineral materials contained in the water also cause impurities or scale formation on the pipe. The scale formation on the pipe will bring about resistance to the transfer of the heat generated from the pipe heater (3), i.e, deterioration of heat transfer efficiency.

SUMMARY OF THE INVENTION

The present invention relates to a pipe heater encircled conduit device, in which a heating element wrapped with a filament having high resistance is provided and a hollow quartz inner tube is inserted at the outside of said heating element to form a pipe heater, both ends of the heating element being connected with an electrode pin respectively. A hollow quartz outer tube is inserted at the outside of the pipe heater, which has an inlet and an outlet on the tube wall. A heat transfer space is thus formed between the inner quartz tube and the outer quartz tube, and insulation members are combined with the respective opening end of both tubes. By the arrangement, the heat energy generated by the pipe heater formed by the heating element within the hollow inner quartz tube can be transferred to the medium which is introduced from the inlet and exhausted from the outlet. Thus, the medium can be heated by the heat energy generated by the heating element itself by both actions of heat conduction and radiation.

BRIEF DESCRIPTION OF THE DRAWINGS

The present invention will be better understood by the detailed description of a preferred embodiment with reference to the accompanying drawings, in which.

DETAILED DESCRIPTION OF THE PREFERRED EMBODIMENTS

The technical contents of the present invention will become more apparent from the detailed description of the preferred embodiments in conjunction with the accompanying drawings.

Figure 1:
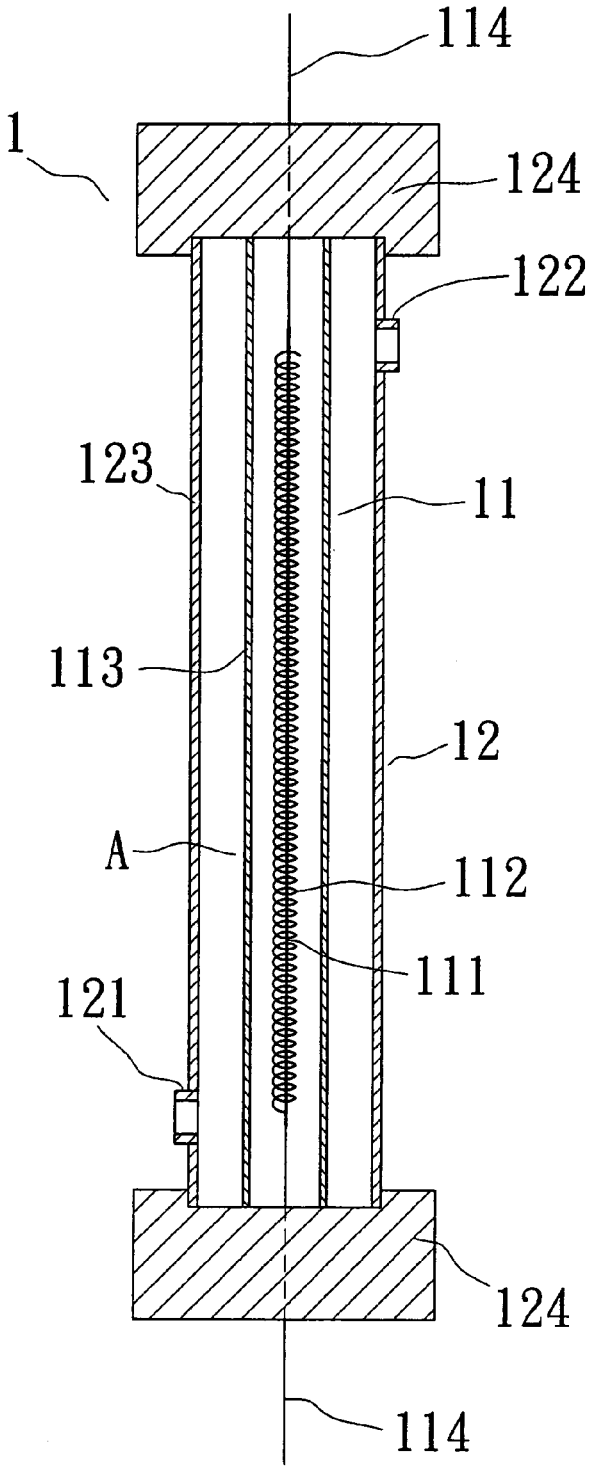
FIG. 1 is a schematic sectional view showing the first embodiment of the present invention.

Firstly referring to FIG. 1, the conduit device (1) of the present invention comprises:

a pipe heater (11) formed by a heating element (111) wrapped with a filament (112) having high resistance and a hollow quartz inner tube (113) inserted at the outside of the heating element (111), both ends of the heating element (111) being connected with a electrode pin (114) respectively;

An outer tube unit (12) having a hollow quartz outer tube (123) inserted at the outside of the pipe heater (11), the quartz outer tube (123) having an inlet (121) and an outlet (122) on the tube wall, a heat transfer space (A) being formed between said inner quartz tube (113) and said outer quartz tube (123), and insulation members (124) being combined with the respective opening end of both tubes, the end of each electrode pin (114) of the pipe heater (11) extending to the outside of said insulation member (124) for the connection with power source.

Figure 2:
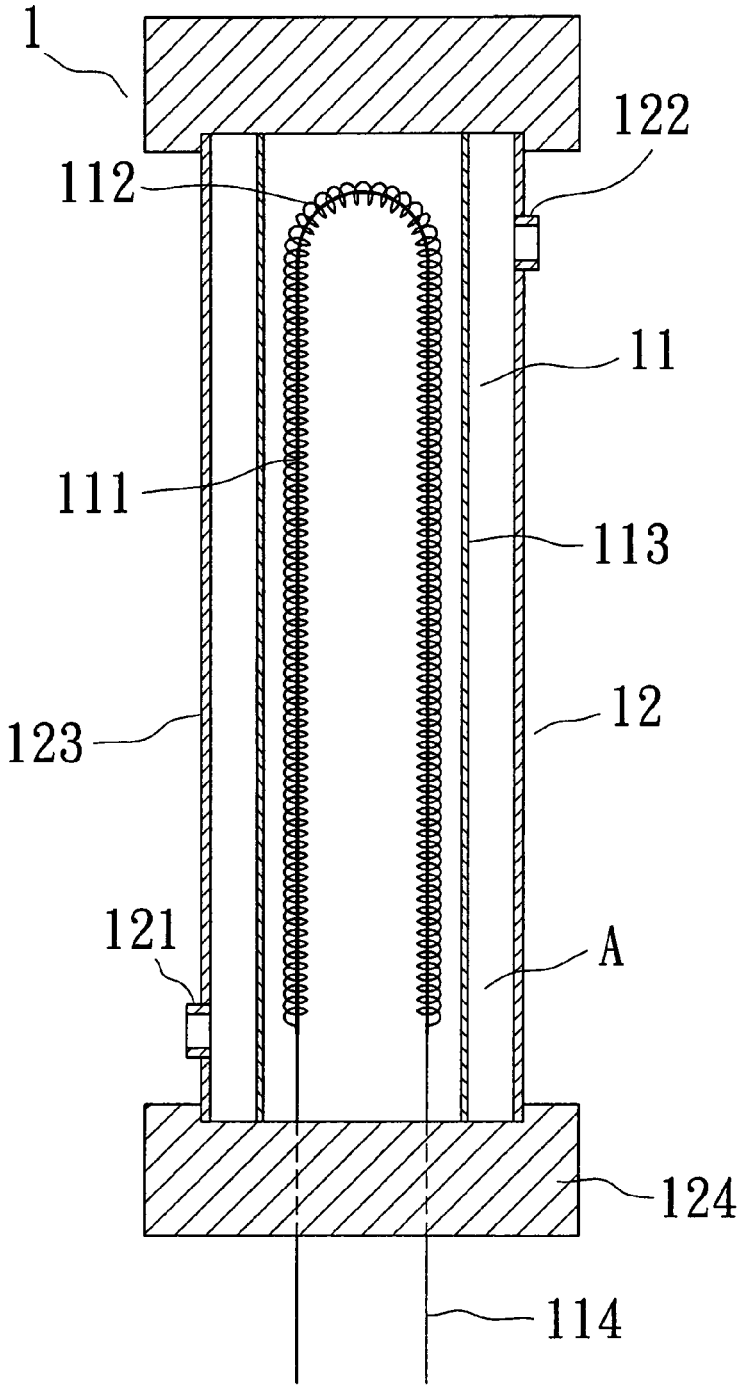
FIG. 2 is a schematic sectional view showing the second embodiment of the present invention.

As shown in FIG. 2, the exterior of the heating element (111) in the pipe heater (11) is wrapped with a filament (112) having high resistances, and both ends of the heating element (111) are connected with electrode pins (114). The number of the heating element (111), wrapped with a filament (112) having high resistance and connecting at both ends with electrode pins (114), can be determined according to the requirement of heat energy generated, for example, the number can be one or more than one. Then, a hollow inner quartz tube (113) is inserted on the outside of the heating element (111) so as to form a pipe heater (11). In turn, the pipe heater (11) is inserted into a hollow outer quartz tube (123) such that the electrode pins (114) extend to the outside from both ends of the hollow outer quartz tube (123). Both ends of the hollow outer quartz tube (123) are combined with the insulation member (124) which for example is made of ceramic material, and both electrode pins (114) are connected with outside power source to become turned-on. In this way, a heat transfer space (A) is thus formed between the hollow outer quartz tube (123) and the hollow inner quartz tube (113) of the pipe heater (11).

Figure 3:
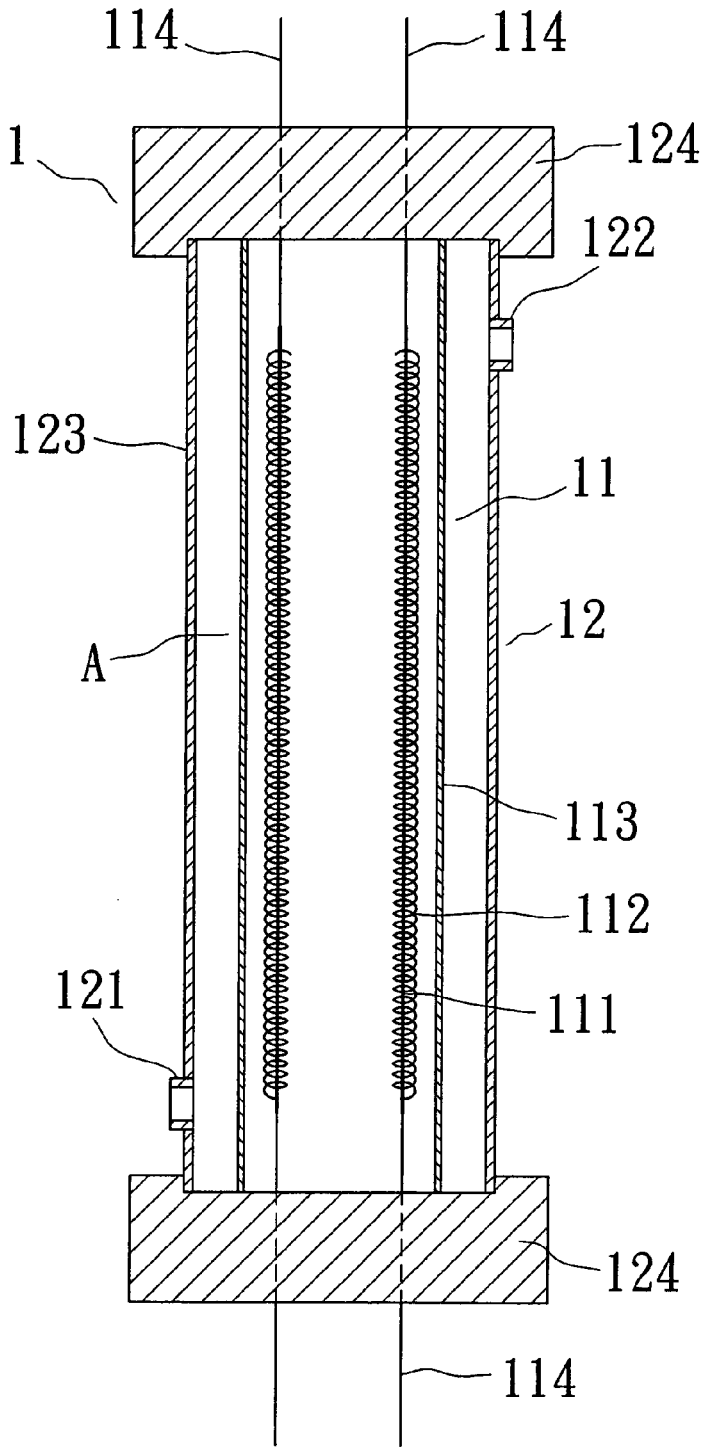
FIG. 3 is a schematic sectional view showing the third embodiment of the present invention.

As shown in FIGS. 1 to 3, when in use, the electrodes pins (114) of the heating element (111) are supplied with power so that the pipe heater (11) begins to generate heat for heating. The heat energy and the light generated from the heat element (111) is transferred out through the wall of the hollow inner quartz tube (113). At this time, a suitable fluid medium is introduced from the inlet (121) of the hollow outer quartz tube (123) into the heat transfer space (A) between the hollow outer quartz tube (123) and the hollow inner quartz tube (113) of the pipe heater (11). The medium within the heat transfer space (A) is heated by the action of radiation and conduction of the heat generated from the heating element (111) such that the medium reaches high temperature rapidly or even evaporates into vapor state. The vapor thus produced is delivered out from the outlet (122) of the hollow outer quartz tube (123) to the place where the heat energy is required. The medium (fluid) can be introduced at a slow pace into the heat transfer space (A) from the inlet (121) of the hollow outer quartz tube (123).

Figure 4:
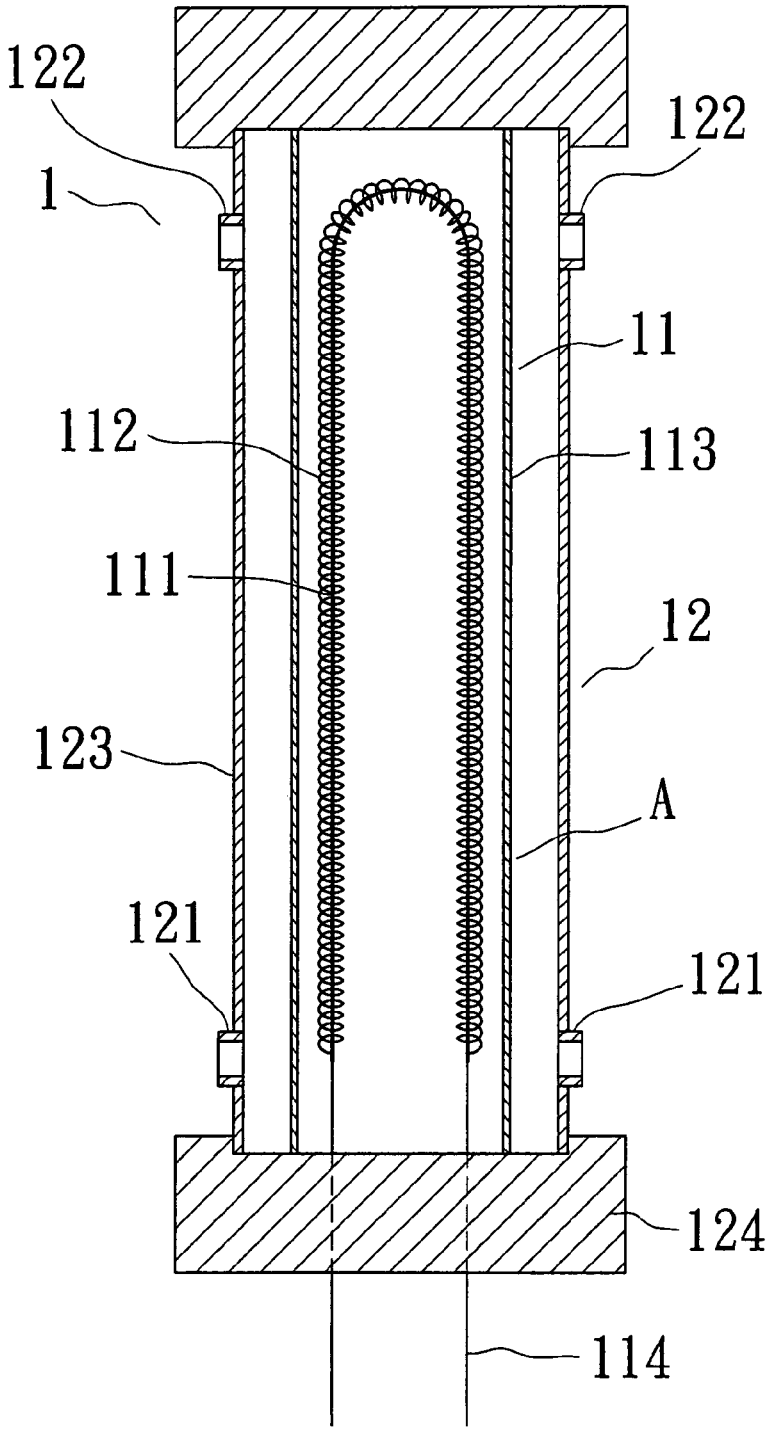
FIG. 4 is a schematic sectional view showing the fourth embodiment of the present invention.
Figure 5:
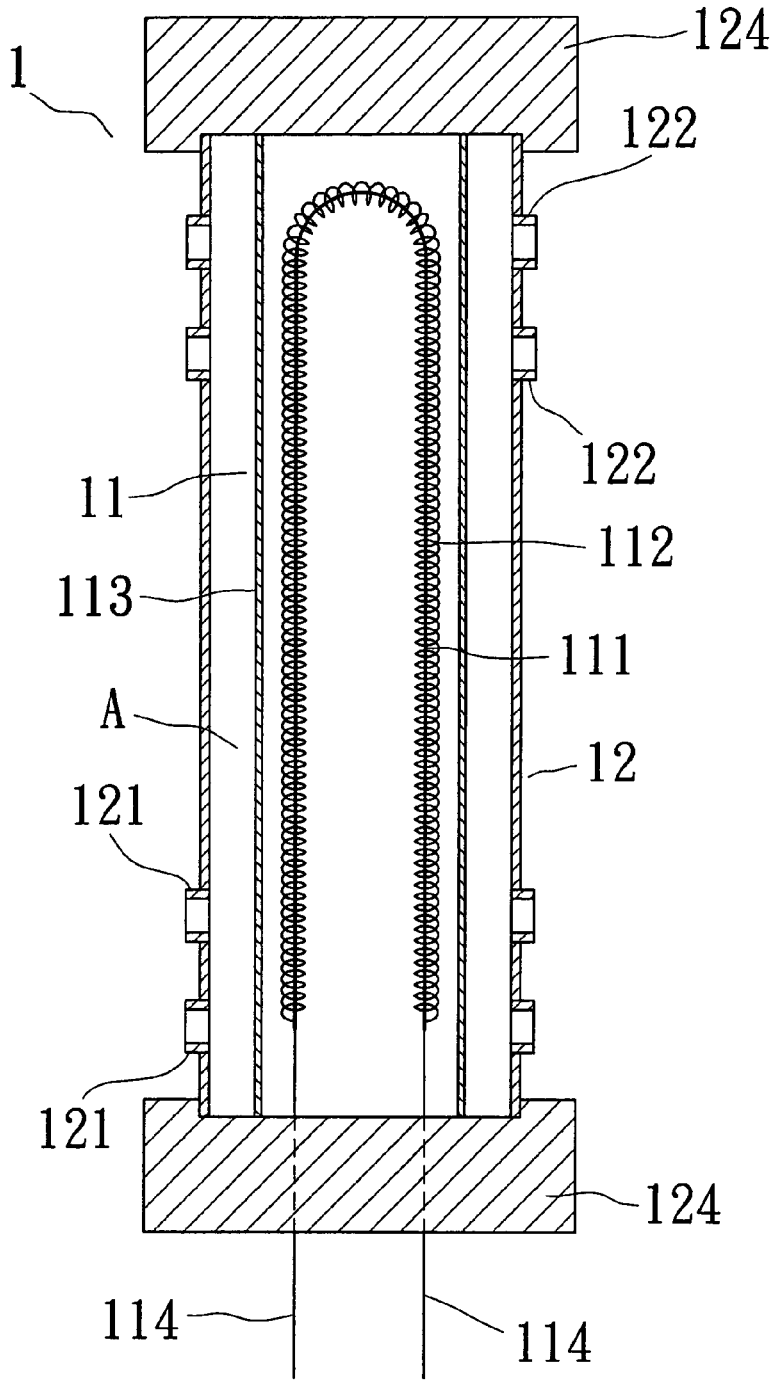
FIG. 5 is a schematic sectional view showing the fifth embodiment of the present invention.
Figure 6:
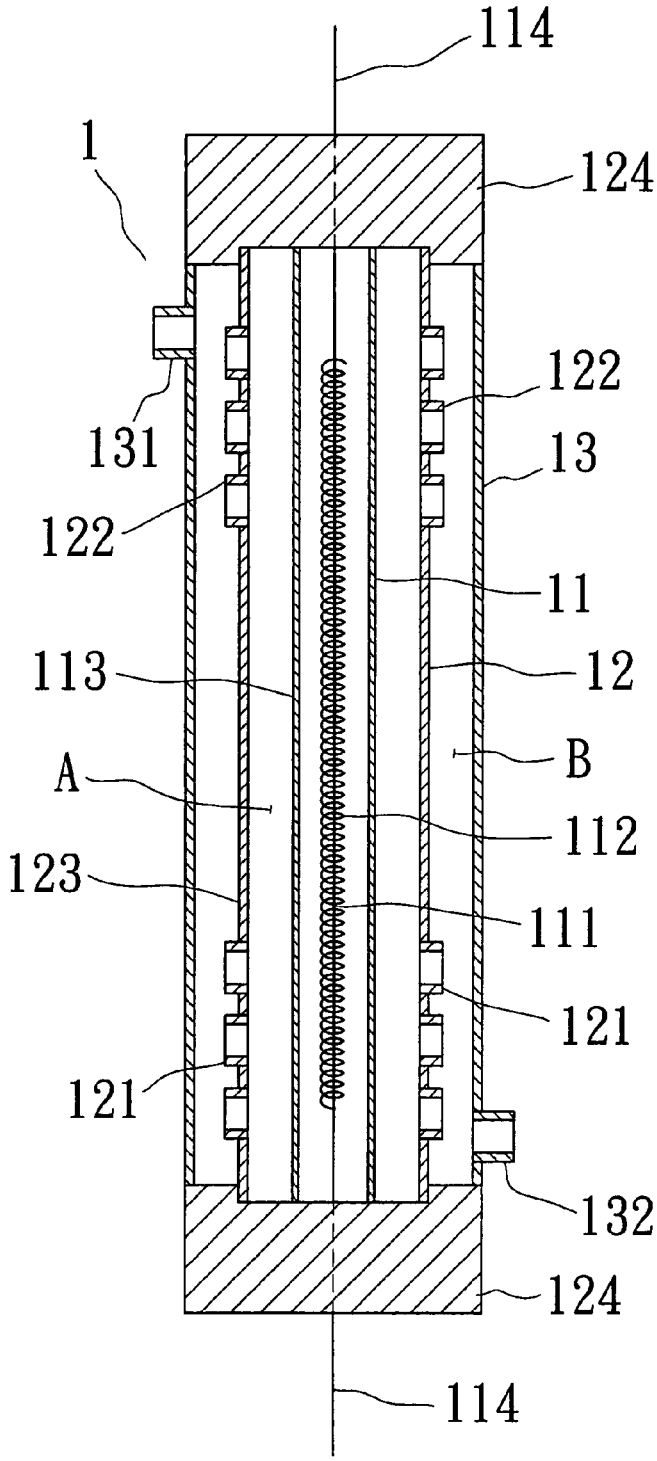
FIG. 6 is a schematic sectional view showing the sixth embodiment of the present invention.
Figure 7:
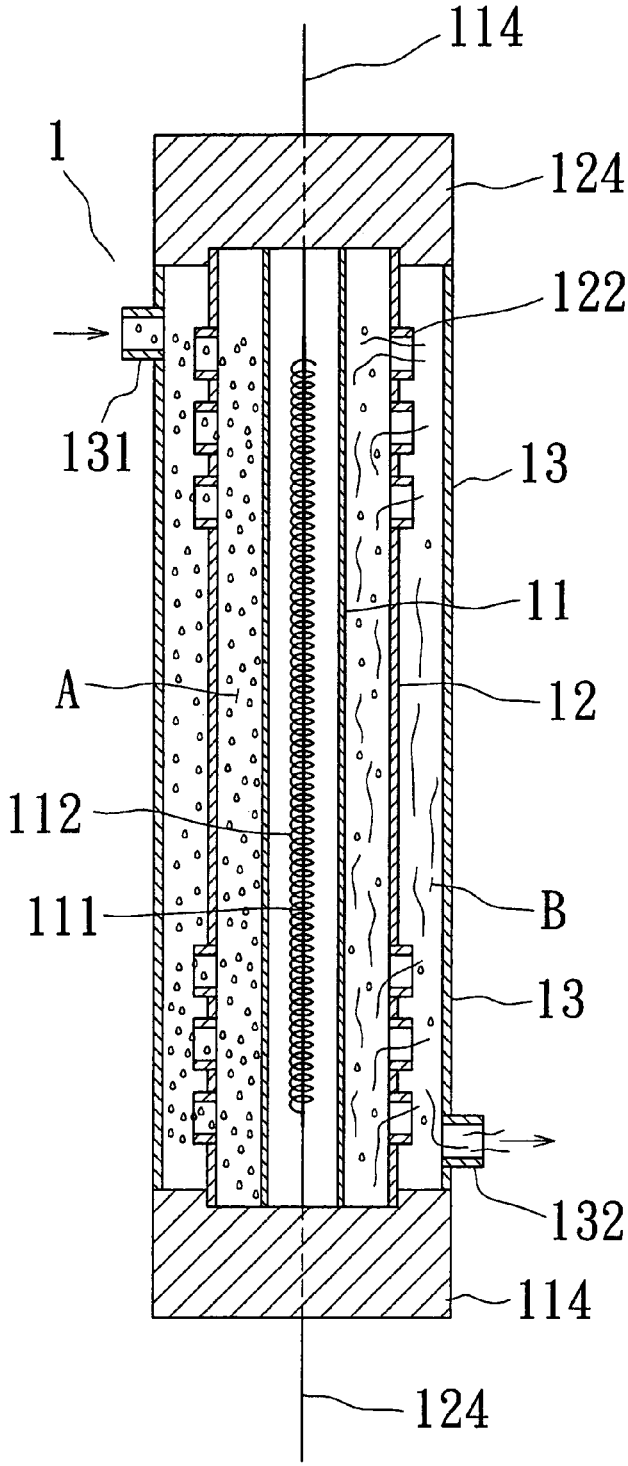
FIG. 7 is a schematic view showing the action of the sixth embodiment of the present invention.
Figure 8:
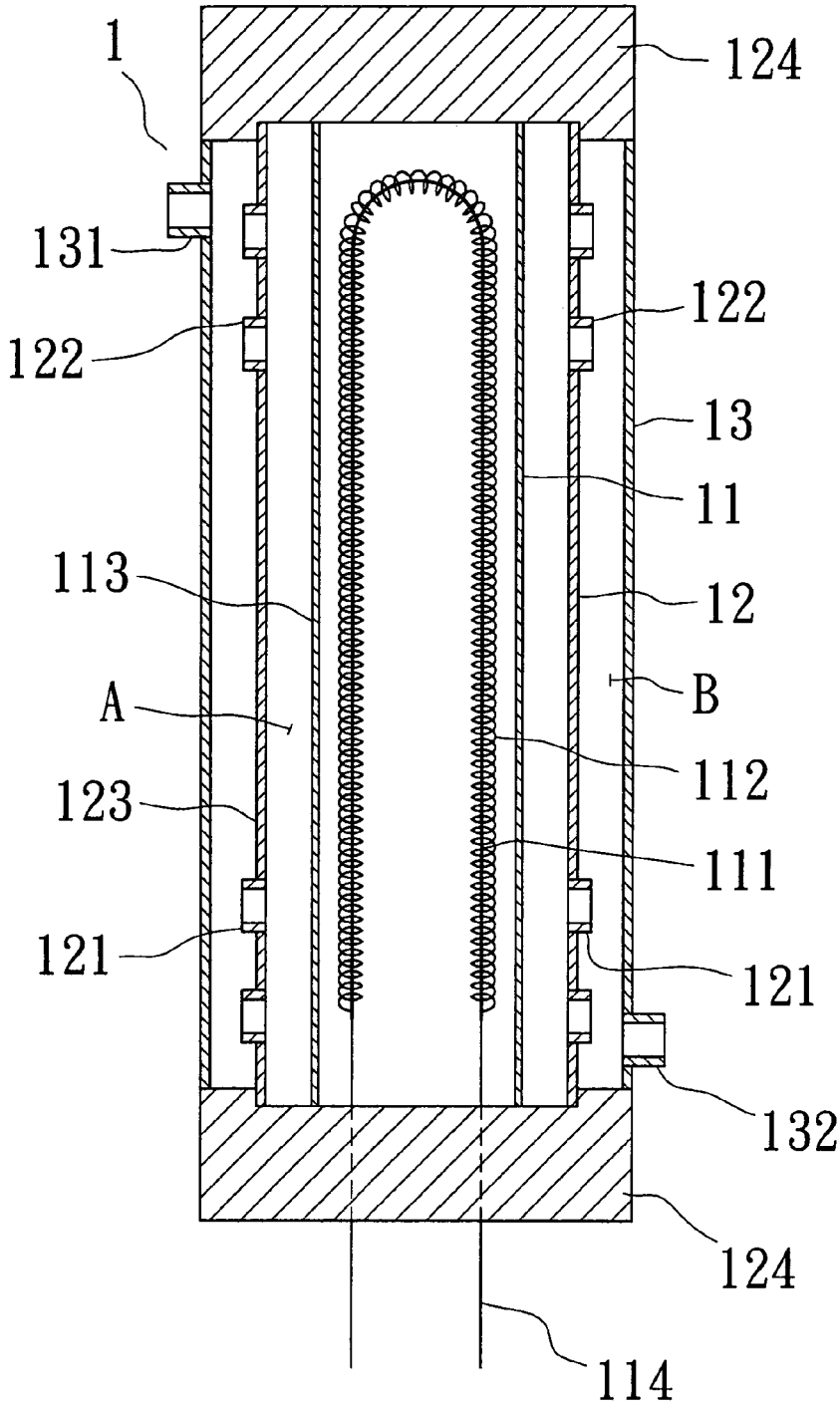
FIG. 8 is a schematic sectional view showing the seventh embodiment of the present invention.
Figure 9:
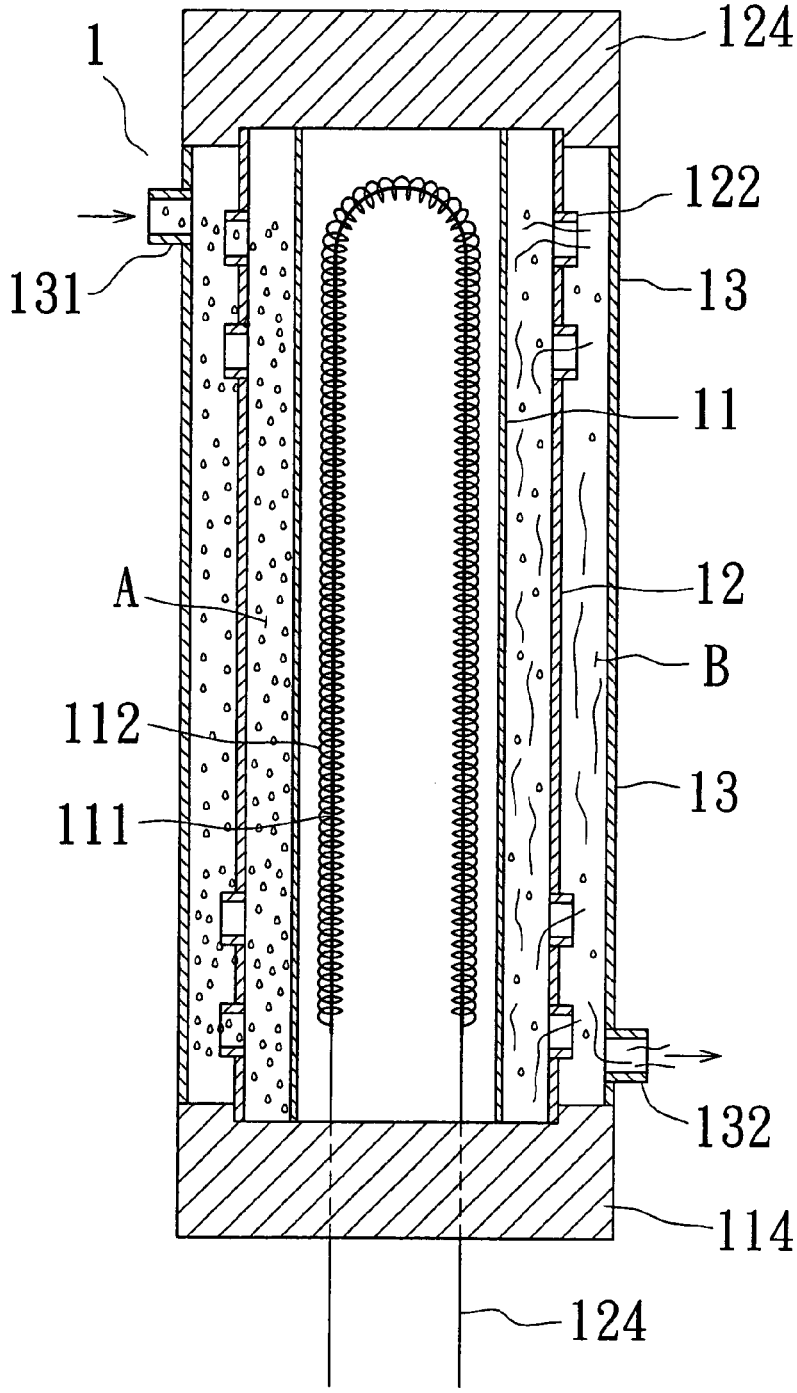
FIG. 9 is a schematic view showing the action of the seventh embodiment of the present invention.
Figure 10:
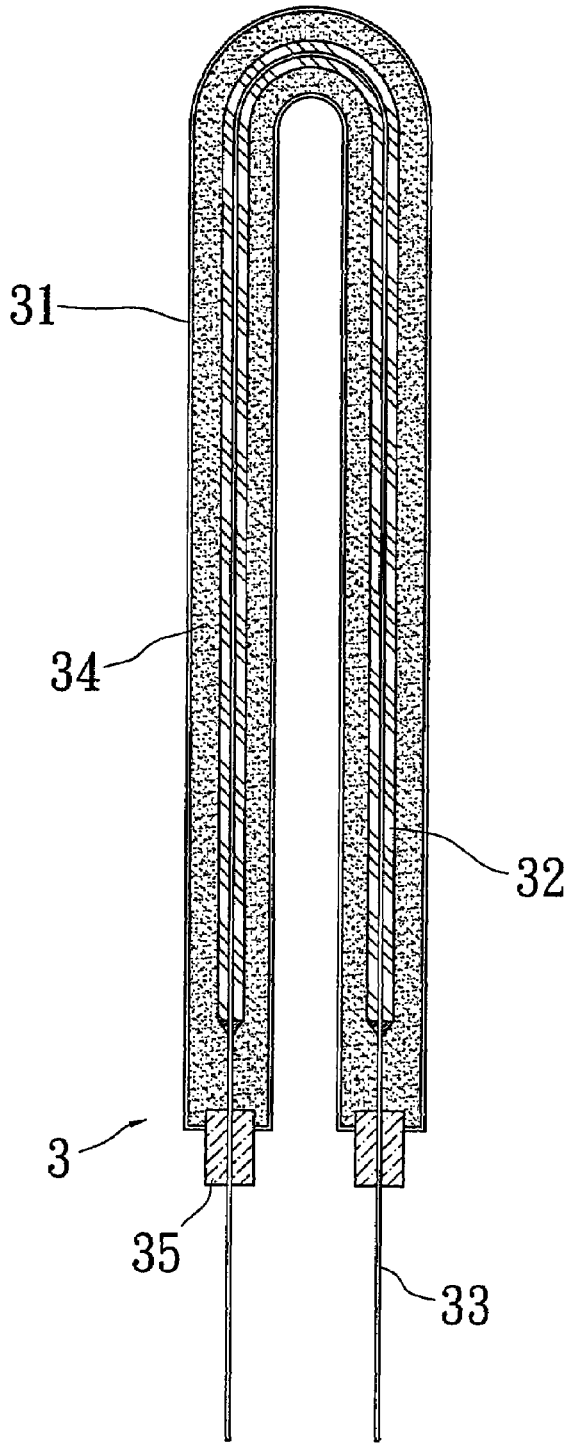
FIG. 10 (PRIOR ART)
FIG. 10 is a schematic sectional view showing a prior art.

As shown in FIGS. 4 and 5, the number of the inlet (121) and the outlet (122) arranged on the hollow outer quartz tube (123) of the conduit device (1) can be provided more than one set respectively according to the heat energy needed by user. The heat energy and light can be effectively transferred to the heat transfer space (A) between the hollow outer quartz tube (123) and the hollow inner quartz tube (113) by both actions of radiation and conduction of the heat generated from the heating element (111) of the pipe heater (11), so that the medium reaches to a high temperature or evaporates to vapor state. Thus, the heat energy generated by the pipe heater (11) formed by the hollow inner quartz tube (113) can be transferred and conducted through the inlet (121) and the outlet (122) of the hollow outer quartz tube (123).

As shown in FIGS. 6 to 9, the conduit device (1) of a further embodiment of the present invention comprises:

a pipe heater (11) formed by a heating element (111) wrapped with filament (112) having high resistance, and a hollow quartz inner tube (113) is inserted at the outside of the heating element (113), the heating element (111) being connected with the respective electrode pin (114);

An outer tube unit (12) has a hollow quartz outer tube (123) inserted at the outside of the pipe heater (11), and the hollow quartz outer tube (123) has an inlet (121) and an outlet (122) on the tube wall. A heat transfer space (A) is thus formed between the inner quartz tube (113) and the outer quartz tube (123), and insulation members (124) are combined with the respective opening end of both tubes. The end of each electrode pin (114) of the pipe heater (11) extends to the outside of the insulation member (124) for the connection with power source;

An outer shield (13) encircling the outside of the hollow outer quartz tube (123) of the outer tube unit (12) and thus a heat convection space (B) being formed between the hollow outer quartz tube (123) and the outer shield (13), both ends of the outer shield (13) being combined with the insulation members (124) respectively and an inlet (131) and an outlet (132) being provided on the outer shield wall respectively.

When in use, the electrodes (114) of the heating element (111) are supplied with power so that the pipe heater (11) begins to generate heat for heating. The heat generated from the heat element (111) is transferred out through the wall of the hollow inner quartz tube (113). The medium within the heat transfer space (A) is heated by both actions of radiation and conduction of the heat generated from the heating element (111) such that the medium reaches high temperature rapidly or evaporates into vapor state. When a suitable fluid medium is introduced from the inlet (131) of the outer shield (13) into the heat convection space (B) and the heat transfer space (A) among the hollow inner quartz tube (113), the hollow outer quartz tube (123) and the outer shield (13), the medium introduced from the outer shield (13) will form vortex circulated heat transfer at a plurality of inlet (121) and a plurality of outlet (122) of the hollow outer quartz tube (123) such that the medium introduced will be fused with the existed medium having heat energy. The heat energy can be effectively transferred to the heat transfer space (A) between the hollow outer quartz tube (123) and the hollow inner quartz tube (113) by both action of radiation and conduction of heat generated from the heating element (111) of the pipe heater (11), so that the medium reaches to a high temperature or boils to vapor state. In turn, vortex circulated heat transfer of the entry fluid and the exit fluid respectively formed at a plurality of inlet (121) and a plurality of outlet (122) of the hollow outer quartz tube (123) will be continuously induced by the cooperation of the continuous heating of the heating element (111) and the continuous introduction of medium from the outer shield (13), such that the medium introduced from the outer shield (13) will be fused and connected with the existed medium at high temperature or in vapor state. Eventually, a mixed medium having high temperature is obtained.

Based on the foregoing, the present invention has a numerous of merits as follow when comparing with the prior art 1. The pipe heater encircled conduit device of the present invention has the function of heating the medium by the heat dissipated from the pipe heater such that medium can be heated to a predetermined high temperature.

2. The pipe heater encircled conduit device of the present invention takes the advantage of excellent heat conductivity and light transitivity such that the heat dissipated by the heating element can be effectively transferred to the heat transfer space between the hollow inner quartz tube and the hollow outer quartz tube by both actions of heat conduction and heat radiation. In this manner, the medium is rapidly heated to a high temperature or evaporated to vapor state.

3. The pipe heater encircled conduit device of the present invention can heat the medium rapidly by the heat energy conducted and radiated from the pipe heater through the heat transfer space between the outer quartz tube and the pipe heater or the heat convection space between the outer shield and the outer quartz tube. Therefore, the medium can be heated instantly to high temperature.

4. The pipe heater encircled conduit device of the present invention takes the advantage of heat convection between a medium with higher temperature and a medium with lower temperature so that the mixed medium having a high temperature is obtain by the rapid heat convection effect.

5. The pipe heater encircled conduit device of the present invention facilitates the heat transfer effect by the vapor formed by high temperature within the tube, the medium with high temperature and the pressure variation, such that a vortex circulated heat convection is induced to achieve rapid heat transfer.

6. By the pipe heater encircled conduit device of the present invention, vortex circulated heat transfer of the entry fluid and the exit fluid respectively formed at a plurality of inlet and a plurality of outlet of the hollow outer quartz tube will be induced by the cooperation of the heating of the heating element and the introduction of medium from the outer shield, such that the medium introduced will be fused with the existed medium with heat energy. In turn, the mixed medium is again subjected to both actions of conduction and radiation of the heat generated from the heating element of the pipe heater itself. Eventually, a mixed medium with high temperature or in vapor state is obtained.

While the present invention has been described with preferred embodiments in conjunction with the accompanying drawings, the preferred embodiments and the drawings are purely for the convenience of description only, and are not intended to be restrictive of the scope of the present invention. Any modifications and variations or the equivalents brought out without departing from the spirit of the present invention is considered to be still within the scope of the present invention.

What is claimed is:

1. A pipe heater encircled conduit device (1), comprising:

a pipe heater (11) formed by a heating element (111) wrapped with a filament (112) having a high resistance and a hollow quartz inner tube (113) encompassing said heating element (111), both ends of said heating element (111) being connected to a respective electrode pin (114);

an outer tube unit (12) having a hollow quartz outer tube (123) overlaying said pipe heater (11) in spaced relationship to define a heat transfer space (A) therebetween, said hollow quartz outer tube (123) having at least one inlet (121) and at least one outlet (122) formed through a wall thereof and being in fluid communication with said heat transfer space; and a pair of insulation members (124) respectively disposed at opposing ends of said outer tube unit to define closures for open ends of said inner tube (113) and said outer tube (123), a distal end of each electrode pin (114) of said pipe heater (11) extending through a respective insulation member (124) to an exterior of said insulation member (124) for connection with a power source.

2. The pipe heater encircled conduit device (1) as claimed in claim 1, wherein said outer quartz tube (123) is provided with a plurality of inlets (121) and a plurality of outlets (122).

3. The pipe heater encircled conduit device (1) as claimed in claim 1, wherein said insulation member (124) is made of ceramic material.

4. A pipe heater encircled conduit device (1), comprising:

a pipe heater (11) formed by a heating element (111) wrapped with a filament (112) having a high resistance and a hollow quartz inner tube (113) encompassing said heating element (113), both ends of said heating element (111) being connected to a respective electrode pin (114);

an outer tube unit (12) having a hollow quartz outer tube (123) overlaying in said pipe heater (11) in spaced relationship to define a heat transfer space (A) therebetween, said hollow quartz outer tube (123) having at least one inlet (121) and at least one outlet (122) formed through a wall thereof and being in fluid communication with said heat transfer space;

an outer shield (13) overlaying said hollow outer quartz tube (123) of said outer tube unit (12) in spaced relationship to define a heat convection space (B) between said hollow outer quartz tube (123) and said outer shield (13), said heat convection space (B) being in fluid communication with said at least one inlet (121) and said at least one outlet (122) of said hollow quartz outer tube (123), said outer shield having an inlet (131) and an outlet (132) respectively formed through a wall thereof and in fluid communication with said heat convection space; and a pair of insulation members (124) respectively disposed at opposing ends of said outer shield (13) to define closures for open ends of said inner tube (113), said outer tube (123) and said outer shield, a distal end of each electrode pin (114) of said pipe heater (11) extending through a respective insulation member (124) to an exterior of said insulation member (124) for connection with a power source.

5. The pipe heater encircled conduit device (1) as claimed in claim 4, wherein said outer quartz tube (123) is provided with a plurality of inlets (121) and a plurality of outlets (122).

6. The A pipe heater encircled conduit device (1) as claimed in claim 4, wherein said insulation member (124) is made of ceramic material.

* * * * *